US012043813B2

(12) United States Patent
Utaka

(10) Patent No.: US 12,043,813 B2
(45) Date of Patent: Jul. 23, 2024

(54) LUBRICATING OIL COMPOSITION

(71) Applicant: IDEMITSU KOSAN CO., LTD., Chiyoda-ku (JP)

(72) Inventor: Toshimasa Utaka, Chiba-chi (JP)

(73) Assignee: IDEMITSU KOSAN CO., LTD., Chiyoda-ku (JP)

( * ) Notice: Subject to any disclaimer, the term of this patent is extended or adjusted under 35 U.S.C. 154(b) by 0 days.

(21) Appl. No.: 17/442,722

(22) PCT Filed: Mar. 27, 2020

(86) PCT No.: PCT/JP2020/014048
§ 371 (c)(1),
(2) Date: Sep. 24, 2021

(87) PCT Pub. No.: WO2020/203784
PCT Pub. Date: Oct. 8, 2020

(65) Prior Publication Data

US 2022/0186137 A1 Jun. 16, 2022

(30) Foreign Application Priority Data

Mar. 29, 2019 (JP) ..... 2019-069049

(51) Int. Cl.

| | |
|---|---|
| ***C10M 135/18*** | (2006.01) |
| ***C10M 125/22*** | (2006.01) |
| ***C10M 129/54*** | (2006.01) |
| ***C10M 133/42*** | (2006.01) |
| ***C10M 133/56*** | (2006.01) |
| ***C10M 137/10*** | (2006.01) |
| ***C10M 169/04*** | (2006.01) |
| *C10N 10/04* | (2006.01) |

(Continued)

(52) U.S. Cl.
CPC ..... *C10M 135/18* (2013.01); *C10M 125/22* (2013.01); *C10M 129/54* (2013.01); *C10M 133/42* (2013.01); *C10M 133/56* (2013.01); *C10M 137/10* (2013.01); *C10M 169/04* (2013.01); *C10M 2201/084* (2013.01); *C10M 2203/1006* (2013.01); *C10M 2207/262* (2013.01); *C10M 2215/222* (2013.01); *C10M 2215/28* (2013.01); *C10M 2219/066* (2013.01); *C10M 2223/045* (2013.01); *C10N 2010/04* (2013.01); *C10N 2010/06* (2013.01); *C10N 2030/04* (2013.01); *C10N 2030/10* (2013.01); *C10N 2030/45* (2020.05); *C10N 2030/52* (2020.05); *C10N 2040/255* (2020.05)

(58) Field of Classification Search
CPC ..... C10M 135/18; C10M 125/22; C10M 129/54; C10M 133/42; C10M 133/56; C10M 137/10; C10M 169/04; C10M 2201/084; C10M 2207/262; C10M 2215/222; C10M 2215/28; C10M 2219/066; C10M 2223/045; C10M 161/00; C10M 157/10; C10M 2207/028; C10M 2215/04; C10M 2215/221; C10M 2219/046; C10M 2219/09; C10N 2030/04; C10N 2030/10; C10N 2030/45; C10N 2030/52; C10N 2040/255
USPC ..... 508/363
See application file for complete search history.

(56) References Cited

U.S. PATENT DOCUMENTS 7,160,845 B2 * 1/2007 Baranski ..... C10L 1/2425 508/567
2009/0312300 A1 12/2009 Li et al.
(Continued)

FOREIGN PATENT DOCUMENTS

EP 3 766 948 A1 1/2021
JP 2000-345184 A 12/2000
(Continued)

OTHER PUBLICATIONS

Japanese Office Action issued Nov. 8, 2022 in Japanese Patent Application No. 2019-069049 (with unedited computer generated English Translation), 6 pages.
(Continued)

*Primary Examiner* — Prem C Singh
*Assistant Examiner* — Francis C Campanell
(74) *Attorney, Agent, or Firm* — Oblon, McClelland, Maier & Neustadt, L.L.P.

(57) ABSTRACT

The invention addresses a problem of providing a lubricating oil composition for gas engines capable of suppressing viscosity increase while reducing a sulfated ash content and excellent in high-temperature detergency and base number retention. The lubricating oil composition is used for gas engines and contains a base oil (A), at least one ash-free additive (B) selected from an ash-free sulfur-based antioxidant (B1) and a hindered amine compound (B2), and a boronated imide-type dispersant (C), and satisfies the following requirements (X1) to (X3): Requirement (X1): the sulfated ash content is 0.2% by mass or less. Requirement (X2): the content of the ash-free additive (B) is 1.2% by mass or less based on the total amount of the lubricating oil composition, provided that in the case where the ash-free additive (B) contains the hindered amine compound (B2), the content of the hindered amine compound (B2) is less than 1.0% by mass based on the total amount of the lubricating oil composition. Requirement (X3): the content of the boron atom derived from the boronated imide-type dispersant (C) is 200 ppm by mass or more based on the total amount of the lubricating oil composition.

8 Claims, No Drawings

(51) Int. Cl.

| | |
|---|---|
| *C10N 10/06* | (2006.01) |
| *C10N 30/00* | (2006.01) |
| *C10N 30/04* | (2006.01) |
| *C10N 30/10* | (2006.01) |
| *C10N 40/25* | (2006.01) |

(56) References Cited

U.S. PATENT DOCUMENTS

| | | | | |
|---|---|---|---|---|
| 2013/0005624 | A1 | 1/2013 | Kamano et al. | |
| 2013/0123156 | A1* | 5/2013 | Chase | C10M 133/42 508/281 |
| 2015/0072907 | A1* | 3/2015 | Iwasaki | C10M 141/12 508/192 |
| 2015/0191673 | A1* | 7/2015 | DeSantis | C10M 141/08 508/588 |
| 2019/0241828 | A1 | 8/2019 | Oki et al. | |

FOREIGN PATENT DOCUMENTS

| | | | |
|---|---|---|---|
| JP | 2001-158896 | A | 6/2001 |
| JP | 2010-209182 | A | 9/2010 |
| JP | 2011-190331 | A | 9/2011 |
| JP | 2013-523952 | A | 6/2013 |
| JP | 2018-48222 | A | 3/2018 |
| WO | WO 2018/105496 | A1 | 6/2018 |
| WO | WO 2019/177125 | A1 | 9/2019 |

OTHER PUBLICATIONS

Extended European Search Report issued Nov. 25, 2022 in European Patent Application No. 20781981.4, 10 pages.

International Search Report mailed on Jun. 9, 2020 in PCT/JP2020/014048 filed on Mar. 27, 2020. 3 pages.

* cited by examiner

LUBRICATING OIL COMPOSITION

TECHNICAL FIELD

The present invention relates to a lubricating oil composition. More precisely, the present invention relates to a lubricating oil composition for use in gas engines.

BACKGROUND ART

A gas engine is an internal-combustion engine that is driven by a gas as a fuel. A gas engine is utilized in, for example, gas cogeneration systems and gas heat pump systems. For these systems, maintenance checkup is a major burden. Consequently, improvement in maintenance performance such as simplification of checkup and prolongation of maintenance frequency is an important issue.

For improving maintenance performance for these systems, it is desired to reduce the exchange frequency with a lubricating oil composition for use in gas engines (hereinafter also referred to as "lubricating composition for gas engines"). For this, one means is improving base number retention and high-temperature detergency of a lubricating oil composition for gas engines.

Heretofore, in general, base number retention and high-temperature detergency of a lubricating oil composition for use for engines is improved by blending a larger amount of a metal-based detergent in the lubricating oil composition. For example, from the viewpoint of improving the performance of a lubricating oil composition for gas engines, PTL 1 says that a sulfated ash content in a lubricating oil composition for gas engines, that is, the metal content derived from an additive such as a metal-based detergent therein is controlled to be 0.5% by mass or more.

CITATION LIST

Patent Literature

PTL 1: JP 2018-048222 A

SUMMARY OF INVENTION

Technical Problem

A metal content derived from an additive such as a metal-based detergent brings about a combustion ash owing to combustion in engines. The combustion ash deposits around the top land in an upper part of a piston in a gas engine to cause damage of ring liners and knocking. From the viewpoint of preventing damage of ring liners and knocking, it is desired to reduce a sulfated ash content in a lubricating oil composition for gas engines.

However, when the amount of a metal-based detergent to be blended in a lubricating oil composition for reducing the sulfated ash content therein, base number retention and high-temperature detergency of the lubricating oil compositions lowers. Namely, in a lubricating oil composition, it is difficult to satisfy both reduction in the sulfated ash content therein and improvement of base number retention and high-temperature detergency of the composition.

Moreover, as compared with a gasoline engine and a diesel engine, a gas engine needs a high combustion temperature and may readily generate nitrogen oxides (hereinafter also referred to as "NOx"). Consequently, a lubricating oil composition for use for gas engines may readily undergo high-temperature oxidation degradation and NOx degradation, and the viscosity thereof may readily increase, and in addition, the lubricating oil composition could hardly secure base number retention and high-temperature detergency. Accordingly, for a lubricating oil composition for gas engines, it is difficult to prevent viscosity increase thereof while also reducing a sulfated ash content therein and to improve base number retention and high-temperature detergency thereof.

An object of the present invention is to provide a lubricating oil composition for gas engines which can prevent viscosity increase while reducing a sulfated ash content and is excellent in high-temperature detergency and base number retention.

Solution to Problem

The present inventor has made assiduous studies for solving the above-mentioned problem. As a result, the inventor has found that a lubricating oi composition, which contains a specific amount of at least one ash-free additive selected from an ash-free sulfur-based antioxidant and a hindered amine compound and also a boronated imide-type dispersant and contains a specific amount of the boron atom derived from the boronated imide-type dispersant, can solve the above-mentioned problem, and has completed the present invention.

Specifically, the present invention relates to the following [1] to [8].

[1] A lubricating oil composition for use in gas engines, which contains a base oil (A), at least one ash-free additive (B) selected from an ash-free sulfur-based antioxidant (B1) and a hindered amine compound (B2), and a boronated imide-type dispersant (C), and satisfies the following requirements (X1) to (X3):

Requirement (X1): a sulfated ash content is 0.2% by mass or less;

Requirement (X2): the content of the ash-free additive (B) is 1.2% by mass or less based on the total amount of the lubricating oil composition, provided that in the case where the ash-free additive (B) contains the hindered amine compound (B2), the content of the hindered amine compound (B2) is less than 1.0% by mass based on the total amount of the lubricating oil composition;

Requirement (X3): the content of the boron atom derived from the boronated imide-type dispersant (C) is 200 ppm by mass or more based on the total amount of the lubricating oil composition.

[2] The lubricating oil composition according to the above [1], wherein in the requirement (X1), the sulfated ash content is 0.01% by mass or more.

[3] The lubricating oil composition according to the above [1] or [2], wherein the ash-free sulfur-based antioxidant (B1) is at least one selected from a thiocarbamate compound, a sulfur-containing triazine compound, a polysulfide compound, and sulfurized oils and fats.

[4] The lubricating oil composition according to any of the above [1] to [3], wherein the hindered amine compound (B2) has one or two piperidine-derived skeletons.

[5] The lubricating oil composition according to any of the above [1] to [4], which further contains a non-boronated imide-type dispersant (D), and wherein: the content of the boron atom derived from the boronated imide-type dispersant (C) relative to the total content of the nitrogen atom derived from the boronated imide-type dispersant (C) and the nitrogen atom derived from the non-boronated imide-type dispersant (D) is 0.10 to 1.0 as a ratio by mass.

[6] The lubricating oil composition according to any of the above [1] to [5], which further contains at least one metal-based detergent (E) selected from a calcium-based detergent (E1) and a magnesium-based detergent (E2), and wherein:

the content of the metal atom derived from the metal-based detergent (E) is 50 to 200 ppm by mass based on the total amount of the lubricating oil composition.

[7] The lubricating oil composition according to any of the above [1] to [6], which further contains a zinc dithiophosphate (F), and wherein:

the content of the phosphorus atom derived from the zinc dithiophosphate (F) is 50 to 300 ppm by mass based on the total amount of the lubricating oil composition.

[8] The lubricating oil composition according to any of the above [1] to [7], which is used in a gas engine equipped in a gas cogeneration system or in a gas engine equipped in a gas heat pump.

Advantageous Effects of Invention

According to the present invention, there can be provided a lubricating oil composition for gas engines which can prevent viscosity increase while reducing a sulfated ash content and is excellent in high-temperature detergency and base number retention.

DESCRIPTION OF EMBODIMENTS

Embodiments of the present invention are described in detail hereinunder.

In the present specification, lower limits and upper limits stepwise described for preferred numerical ranges (for example, range of content) can be each independently combined. For example, from a description of "preferably 10 to 90, more preferably 30 to 60", "a preferred lower limit (10)" and "a more preferred upper limit (60)" can be combined to be "10 to 60".

Similarly, in the present specification, numerical values of "or more", "or less", "less than", and "more than" for description of numerical ranges are also numerical values that can be combined arbitrarily.

Also in the present specification, numerical values in Examples are numerical values that can be used as upper limits or lower limits.

In the present specification, "base number retention" is meant to indicate a capability of maintaining the base number of a lubricating oil composition for a long period of time, even in the same environment as that for gas engines that undergo high-temperature oxidation degradation and NOx degradation.

In the present specification, "high-temperature detergency" is meant to indicate a capability of preventing adhesion of sludge and deposits (mainly carbon deposits) formed in a lubricating oil composition to the inside of gas engines to thereby keep the inside of lubrication routes such as pistons or around pistons clean, even in the case where a lubricating oil composition is degraded in the same environment as that for gas engines that undergo high-temperature oxidation degradation and NOx degradation.

[Embodiment of Lubricating Oil Composition for Gas Engines of the Invention]

The lubricating oil composition of the present invention is a lubricating oil composition for use in gas engines, which contains a base oil (A), at least one ash-free additive (B) selected from an ash-free sulfur-based antioxidant (B1) and a hindered amine compound (B2), and a boronated imide-type dispersant (C), and satisfies the following requirements (X1) to (X3):

Requirement (X1): a sulfated ash content is 0.2% by mass or less;

Requirement (X2): the content of the ash-free additive (B) is 1.2% by mass or less based on the total amount of the lubricating oil composition, provided that in the case where the ash-free additive (B) contains the hindered amine compound (B2), the content of the hindered amine compound (B2) is less than 1.0% by mass based on the total amount of the lubricating oil composition;

Requirement (X3): the content of the boron atom derived from the boronated imide-type dispersant (C) is 200 ppm by mass or more based on the total amount of the lubricating oil composition.

As a result of assiduous investigations, the present inventor has found that a lubricating oil composition containing a specific amount of at least one ash-free additive (B) selected from an ash-free sulfur-based antioxidant (B1) and a hindered amine compound (B2), containing a boronated imide-type dispersant (C), and containing a specific amount of the boron atom derived from the boronated imide-type dispersant can suppress viscosity increase and is excellent in high-temperature detergency and base number retention even though having a low sulfated ash content.

In the present invention, "low sulfated ash content" means that the sulfated ash content falls within the range indicated by the above requirement (X1). Specifically, this means that the sulfated ash content is 0.2$ by mass or less.

In the lubricating oil composition of one embodiment of the present invention, from the viewpoint of more readily preventing damage of ring liners and knocking to be caused by the combustion ash derived from a metal component such as a metal-based detergent, the sulfated ash content is preferably 0.15% by mass or less, more preferably 0.11% by mass or less, even more preferably 0.08% by mass or less, further more preferably 0.05% by mass or less, further more preferably 0.03% by mass or less. Also it is preferably 0.01% by mass or more.

In the following description in the present specification, "base oil (A)", "ash-free additive (B)" and "boronated imide-type dispersant (C)" may be referred to as "component (A)", "component (B)" and component (C)", respectively. Also the ash-free sulfur-based antioxidant (B1) and the hindered amine compound (B2) may be referred to as "component (B1)" and component (B2)", respectively.

In the lubricating oil composition of one embodiment of the present invention, the total content of the component (A), the component (B) and the component (C) is preferably 70% by mass or more based on the total amount of the lubricating oil composition, more preferably 75% by mass or more, even more preferably 80% by mass or more.

In the lubricating oil composition of one embodiment of the present invention, the upper limit of the total content of the component (A), the component (B) and the component (C) can be controlled depending on the relationship between the total content and the content of the other additive for lubricating oil than the component (B) and the component (C), and is preferably 98% by mass or less, more preferably 95% by mass or less, even more preferably 92% by mass or less.

In the lubricating oil composition of one embodiment of the present invention, the other additive for lubricating oil than the component (B) and the component (C) includes a non-boronated imide-type dispersant (D), at least one metal-based detergent (E) selected from a calcium-based detergent (E1) and a magnesium-based detergent (E2), and a zinc dithiophosphate (F).

In the following description in the present specification, "non-boronated imide-type dispersant (D)", "metal-based detergent (E)", and "zinc dithiophosphate (F)" may be referred to as "component (D)", "component (E)" and "component (F)", respectively. Also, "calcium-based detergent (E1)" and "magnesium-based detergent (E2) may be referred to as "component (E1)" and "component (E2)", respectively.

The lubricating oil composition of one embodiment of the present invention may further contain any other additive for lubricating oil than the component (B), the component (C), the component (D), the component (E) and the component (F), within a range not detracting from the advantageous effects of the present invention.

The components contained in the lubricating oil composition of the present invention are described in detail hereinunder.

<Base Oil (A)>

The lubricating oil composition of the present invention contains a base oil (A).

For the base oil (A) that the lubricating oil composition of the present invention contains, one or more selected from mineral oils and synthetic oils heretofore used as a base oil for lubricating oil can be used with no specific limitation.

Examples of the mineral oil include atmospheric residues obtained through atmospheric distillation of crude oils such as paraffin-base crude oils, intermediate-base crude oils or naphthene-base crude oils; distillates obtained through reduced-pressure distillation of such atmospheric residues; mineral oils obtained by purifying the distillates through one or more purification treatments of solvent deasphalting, solvent extraction, hydrocracking, solvent dewaxing, catalytic dewaxing or hydrorefining.

Examples of the synthetic oil include poly-α-olefins such as α-olefin homopolymers and α-olefin copolymers (e.g., C8-14 α-olefin copolymers such as ethylene-α-olefin copolymers); isoparaffin; various esters such as polyol esters and diacid esters; various ethers such as polyphenyl ethers; polyalkylene glycols; alkylbenzenes; alkylnaphthalenes; and GTL-base oils obtained by isomerization of wax (gas-to-liquid (GTL) wax) produced from a natural gas through Fischer-Tropsch synthesis.

The base oil (A) for use in one embodiment of the present invention is preferably a base oil grouped in Group 2, 3 or 4 in the base oil category of American Petroleum Institute (API), more preferably a base oil grouped in Group 2 or 3.

As the base oil (A), one kind alone or two or more kinds of mineral oil may be used either singly or as combined, or one kind alone or two or more kinds of synthetic oil may be used either singly or as combined. Also, one or more kinds of mineral oil and one or more kinds of synthetic oil may be combined and used.

The kinematic viscosity at 100° C. (hereinafter also referred to as "100° C. kinematic viscosity") of the base oil (A) is preferably 2 to 20 $mm^2/s$, more preferably 3 to 15 $mm^2/s$, even more preferably 4 to 12 $mm^2/s$.

When the 100° C. kinematic viscosity of the base oil (A) is 2 $mm^2/s$ or more, evaporation loss can be readily suppressed.

When the 100° C. kinematic viscosity of the base oil (A) is 20 $mm^2/s$ or less, power loss owing to viscous resistance can be readily suppressed and an effect of improving fuel efficiency can be readily attained.

The viscosity index of the base oil (A) is, from the viewpoint of suppressing viscosity change accompanied by temperature change and improving fuel-saving performance, preferably 80 or more, more preferably 90 or more, even more preferably 100 or more.

In the present specification, the 100° C. kinematic viscosity and the viscosity index mean values measured or calculated according to JIS K 2283:2000.

In one embodiment of the present invention where the base oil (A) is a mixed base oil containing two or more kinds of base oil, preferably, the kinematic viscosity and the viscosity index of the mixed base oil each fall the above-mentioned range.

In the lubricating oil composition of one embodiment of the present invention, the content of the base oil (A) is preferably 90% by mass or less based on the total amount (100% by mass) of the lubricating oil composition. By controlling the content of the base oil (A) to be 90% by mass or less, at least one ash-free additive selected from an ash-free sulfur-based antioxidant (B1) and a hindered amine compound (B2) and a boronated imide-type dispersant (C) can be blended each in an appropriate amount, and the advantageous effects of the present invention can be thereby more readily attained.

From the viewpoint of more efficiently improving the advantageous effects of the present invention, the content of the base oil (A) is preferably 65 to 95% by mass based on the total amount of the lubricating oil composition, more preferably 70 to 90% by mass, even more preferably 70 to 87% by mass.

<Ash-Free Additive (B)>

The lubricating oil composition of the present invention contains at least one ash-free additive (B) selected from an ash-free sulfur-based antioxidant (B1) and a hindered amine compound (B2).

The ash-free sulfur-based antioxidant (B1) and the hindered amine compound (B2) do not contain a metal atom, and therefore do not increase a sulfated ash content of the lubricating oil composition. Consequently, a lubricating oil composition having a low sulfated ash content can be readily prepared.

When the lubricating oil composition contains neither the ash-free sulfur-based antioxidant (B1) nor the hindered amine compound (B2), the composition cannot secure base number retention.

The lubricating oil composition of the present invention satisfies the following requirement (X2).

Requirement (X2): the content of the ash-free additive (B) is 1.2% by mass or less based on the total amount of the lubricating oil composition, provided that in the case where the ash-free additive (B) contains the hindered amine compound (B2), the content of the hindered amine compound (B2) is less than 1.0% by mass based on the total amount of the lubricating oil composition.

When the content of the ash-free additive (B) is more than 1.2% by mass based on the total amount of the lubricating oil composition, viscosity increase to be caused by high-temperature oxidation degradation and NOx degradation cannot be suppressed.

Also when the content of the hindered amine compound (B2) is 1.0% by mass or more based on the total amount of the lubricating oil composition, the lubricating oil composition has a risk of gelation owing to high-temperature oxidation degradation and NOx degradation.

From the viewpoint of more readily suppressing viscosity increase and more efficiently securing excellent base number retention, the content of the ash-free additive (B) in the lubricating oil composition of one embodiment of the present invention is preferably 0.10 to 1.1% by mass based on the total amount of the lubricating oil composition, more preferably 0.30 to 1.1% by mass, even more preferably 0.50 to 1.0% by mass, further more preferably 0.70 to 0.95% by mass.

(Ash-Free Sulfur-Based Antioxidant (B1))

The ash-free sulfur-based antioxidant (B1) includes one or more selected from a thiocarbamate compound, a sulfur-containing triazine compound, a polysulfide compound, and sulfurized oils and fats.

Among these, one or more selected from a thiocarbamate compound and a sulfur-containing triazine compound are preferred from the viewpoint of more readily securing the advantageous effects of the present invention, and a thiocarbamate compound is more preferred.

Hereinunder a thiocarbamate compound (B1-1), a sulfur-containing triazine compound (B1-2), a polysulfide compound (B1-3), and sulfurized oils and fats (B1-4) are described.

(Thiocarbamate Compound (B1-1))

Examples of the thiocarbamate compound (B1-1) include compounds shown by the following general formulae (b1-1a) and (b1-1b).

One alone or two or more kinds of these compounds may be used either singly or as combined.

(b1-1a)

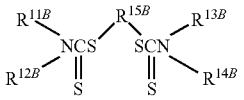

(b1-1b)

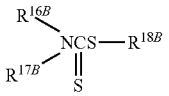

In the general formula (b1-1a), $R^{11B}$ to $R^{14B}$ each represent an alkyl group having 1 to 30 carbon atoms, or a phenyl group, $R^{11B}$ to $R^{14B}$ may be the same or different. $R^{15B}$ represents an alkylene group having 1 to 10 carbon atoms.

Here, in the general formula (b1-1a), $R^{11B}$ to $R^{14B}$ each are preferably an alkyl group having 2 to 12 carbon atoms, or a phenyl group, more preferably an alkyl group having 2 to 8 carbon atoms or a phenyl group, even more preferably an alkyl group having 3 to 5 carbon atoms. $R^{11B}$ to $R^{14B}$ are preferably the same. In the general formula (b1-1a), $R^{5B}$ is preferably an alkylene group having 1 to 2 carbon atoms, more preferably an alkylene group having one carbon atom (a methylene group).

In the general formula (b1-1b), $R^{16B}$ to $R^{17B}$ each represent an alkyl group having 1 to 30 carbon atoms, or a phenyl group, $R^{16B}$ to $R^{17B}$ may be the same or different. $R^{18B}$ represents a hydrogen atom or an alkylene group having 1 to 10 carbon atoms.

Here, in the general formula (b1-1b), $R^{16B}$ to $R^{17B}$ each are preferably an alkyl group having 2 to 12 carbon atoms, or a phenyl group, more preferably an alkyl group having 2 to 8 carbon atoms or a phenyl group, even more preferably an alkyl group having 3 to 5 carbon atoms. $R^{16B}$ to $R^{17B}$ are preferably the same. In the general formula (b1-1b), $R^{18B}$ is preferably an alkylene group having 1 to 2 carbon atoms.

Specific examples of the thiocarbamate compound of the general formula (b1-1a) include methylene bis(diethylthiocarbamate), ethylene bis(diethyldithiocarbamate), methylene bis(dipropylthiocarbamate), ethylene bis(dipropyldithiocarbamate), methylene bis(dibutyldithiocarbamate), ethylene bis(dibutyldithiocarbamate), methylene bis(dipentyldithiocarbamate), ethylene bis(dipentyldithiocarbamate), methylene bis(dihexyldithiocarbamate), and ethylene bis(dihexyldithiocarbamate).

Among these, methylene bis(dibutyldithiocarbamate) and ethylene bis(dibutyldithiocarbamate) are preferred, and methylene bis(dibutyldithiocarbamate) is more preferred.

One alone or two or more kinds of these may be used either singly or as combined.

Specific examples of the thiocarbamate compound of the general formula (b1-1b) include diethylthiocarbamic acid, methylene; diethylthiocarbamate, ethylene diethyldithiocarbamate, dipropylthiocarbamic acid, methylene dipropylthiocarbamate, ethylene dipropyldithiocarbamate, dibutyldithiocarbamic acid, methylene dibutyldithiocarbamate, ethylene dibutyldithiocarbamate, dipentyldithiocarbamic acid, methylene dipentyldithiocarbamate, ethylene dipentyldithiocarbamate, methylene dihexyldithiocarbamate, and ethylene dihexyldithiocarbamate.

One alone or two or more kinds of these may be used either singly or as combined.

Among the above-mentioned thiocarbamate compounds, one or more selected from the thiocarbamate compounds of the general formula (b1-1a) are preferably used.

(Sulfur-Containing Triazine Compound (B1-2))

The sulfur-containing triazine compound includes compounds having a sulfur atom and a triazine skeleton in the molecule. The sulfur-containing triazine compound is preferably a compound further having a hindered phenol skeleton.

One alone or two or more kinds of sulfur-containing triazine compounds may be used either singly or as combined.

Preferred examples of the sulfur-containing triazine compound include 2,6-di-tert-butyl-4-(4,6-bis(octylthio)-1,3,5-triazin-2-ylamino)phenol, 2,6-di-tert-butyl-4-(4,6-bis(hexylthio)-1,3,5-triazin-2-ylamino)phenol, and 2,6-di-tert-butyl-4-(4,6-bis(decylthio)-1,3,5-triazin-2-ylamino)phenol.

Among these, 2,6-di-tert-butyl-4-(4,6-bis(octylthio)-1,3,5-triazin-2-ylamino)phenol is preferably used.

(Polysulfide Compound (B1-3))

The polysulfide compound includes one or more selected from compounds (dihydrocarbyl polysulfides) represented by the following general formula (b1-3).

$$R^{21}—S_x—R^{22} \quad \text{(b1-3)}$$

In the above general formula (b1-3), $R^{21}$ and $R^{22}$ each independently represent a hydrocarbon group selected from an alkyl group having 3 to 20 carbon atoms, an aryl group having 6 to 20 carbon atoms, an alkylaryl group having 7 to 20 carbon atoms, an arylalkyl group having 7 to 20 carbon atoms, or an alkenyl group having 3 to 20 carbon atoms, and these may be the same or different, and x represents an integer of 2 to 10. The alkyl group and the alkenyl group in $R^{21}$ and $R^{22}$ may be linear or branched.

In the above general formula (b1-3), $R^{21}$ and $R^{22}$ each preferably have 6 to 18 carbon atoms, x is preferably 2 to 8, more preferably 3 to 7.

Specific examples of the dihydrocarbyl polysulfide include a dialkyl polysulfide, an olefin polysulfide and a dibenzyl polysulfide.

One alone or two or more kinds of these may be used either singly or as combined.

The olefin polysulfide includes those produced by reacting an olefin having 3 to 20 carbon atoms or a dimer to tetramer thereof with a sulfurizing agent such as sulfur or a sulfur halide. Preferred examples of the olefin include propylene, isobutene and diisobutene. The olefin polysulfide includes those of the general formula (b1-3) where one of $R^{21}$ and $R^{22}$ is an alkenyl group and the other is an alkenyl group or an alkyl group.

(Sulfurized Oils and Fats (B1-4))

Sulfurized oils and fats are sulfides of animal or vegetable oils, and examples thereof include sulfurized lard, sulfurized rapeseed oil, sulfurized castor oil, and sulfurized soybean oil. Sulfurized oils and fats also include sulfurized fatty acids such as sulfurized oleic acid, and sulfurized esters such as sulfurized methyl oleate.

One alone or two or more kinds of these may be used either singly or as combined.

(Content of Ash-Free Sulfur-Based Antioxidant (B1))

The content of the ash-free sulfur-based antioxidant (B1) in the lubricating oil composition of one embodiment of the present invention is, from the viewpoint of more readily securing the advantageous effects of the present invention, preferably 0.1 to 1.1% by mass based on the total amount of the lubricating oil composition, more preferably 0.2 to 1.0% by mass, even more preferably 0.3 to 1.0% by mass.

(Hindered Amine Compound (B2))

Not specifically limited, examples of the hindered amine compound (B2) for use in the present invention include compounds having one or two piperidine-derived skeleton represented by the following general formula (b2-1) in the molecule. One alone or two or more kinds of hindered amine compounds (B2) can be used either singly or as combined.

(b2-1)

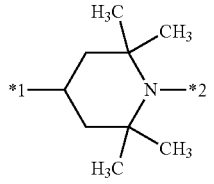

(In the formula (b2-1), *1 and *2 each indicate a bonding position to other atom.)

More specifically, the hindered amine compound (B2) is preferably one or more selected from compounds represented by the following general formula (b2-1a) (number of piperidine-derived skeleton: one) and compounds represented by the following general formula (b2-1b) (number of piperidine-derived skeletons: two), and is, from the viewpoint of more improving high-temperature detergency, more preferably one or more selected from compounds represented by the following general formula (b2-1a) (number of piperidine-derived skeleton: one).

Further more specifically, one or more selected from compounds represented by the following general formula (b2-1c) (number of piperidine-derived skeleton: one) and compounds represented by the following general formula (b2-1d) (number of piperidine-derived skeletons: two) are more preferred, and from the viewpoint of more improving high-temperature detergency, one or more selected from compounds represented by the following general formula (b2-1c) (number of piperidine-derived skeleton: one) are even more preferred.

(b2-1a)

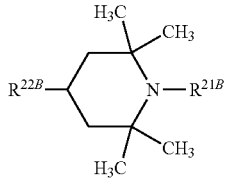

(b2-1b)

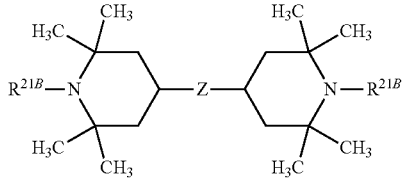

(b2-1c)

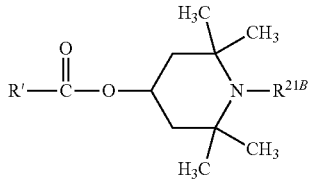

(b2-1d)

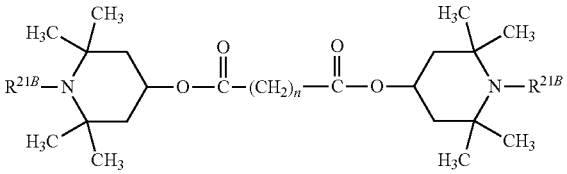

In the general formulae (b2-1a) to (b2-1d), $R^{21B}$ each independently represents a hydrogen atom or an alkyl group having 1 to 10 carbon atoms, preferably a hydrogen atom or an alkyl group having 1 to 3 carbon atoms, more preferably a hydrogen atom or a methyl group.

In the general formula (b2-1a), $R^{22B}$ represents a hydrogen atom, an alkyl group having 1 to 20 carbon atoms, a cycloalkyl group having 6 to 18 ring carbon atoms, an aryl group having 6 to 18 ring carbon atoms, a hydroxy group, an amino group or a group represented by —O—CO—R' (where R' represents a hydrogen atom or an alkyl group having 1 to 20 carbon atoms).

In the general formula (b2-1b), Z represents an alkylene group having 1 to 20 carbon atoms, a cycloalkylene group having 6 to 18 ring carbon atoms, an arylene group having 6 to 18 ring carbon atoms, an oxygen atom, a sulfur atom, or a group represented by —O—CO—$(CH_2)_n$—CO—O— (where n is an integer of 1 to 20).

In the general formula (b2-1c), R' represents a hydrogen atom or an alkyl group having 1 to 20 carbon atoms, preferably an alkyl group having 5 to 15 carbon atoms, more preferably an alkyl group having 8 to 13 carbon atoms.

In the general formula (b2-1d), n represents an integer of 1 to 20, preferably an integer of 3 to 15, more preferably an integer of 5 to 10.

(Content of Hindered Amine Compound (B2))

In the lubricating oil composition of one embodiment of the present invention, the content of the hindered amine compound (B2) is, from the viewpoint of more readily securing the advantageous effects of the present invention, preferably 0.1 to less than 1.0% by mass based on the total amount of the lubricating oil composition, more preferably 0.3 to 0.8% by mass, even more preferably 0.4 to 0.6% by mass.

(Content Ratio of Ash-Free Sulfur-Based Antioxidant (B1) to Hindered Amine Compound (B2))

In the lubricating oil composition of one embodiment of the present invention containing both the ash-free sulfur-based antioxidant (B1) and the hindered amine compound (B2), the content ratio of the ash-free sulfur-based antioxidant (B1) to the hindered amine compound (B2) [(B1)/(B2)] is, from the viewpoint of more readily securing the advantageous effects of the present invention, preferably 1/10 to 10/1 by mass, more preferably 1/5 to 5/1, even more preferably 2/5 to 5/2, further more preferably 3/5 to 5/3.

<Boronated Imide-Type Dispersant (C), Non-Boronated Imide-Type Dispersant (D)>

The lubricating oil composition of the present invention contains the boronated imide-type dispersant (C).

Also the lubricating oil composition of one embodiment of the present invention may contain a non-boronated imide-type dispersant (D) along with the boronated imide-type dispersant (C). The non-boronated imide-type dispersant is generally called an imide-type dispersant.

The boronated imide-type dispersant (C) and the non-boronated imide-type dispersant (D) do not contain a metal atom, and therefore do not increase the sulfated ash content of the lubricating oil composition. Consequently, a lubricating oil composition having a low sulfated ash content can be readily prepared.

The lubricating oil composition of the present invention satisfies the following requirement (X3).

Requirement (X3): the content of the boron atom derived from the boronated imide-type dispersant (C) is 200 ppm by mass or more based on the total amount of the lubricating oil composition.

Satisfying the requirement (X3), the lubricating oil composition can synergistically exhibit the effect of enhancing base number retention to be attained by the boronated imide-type dispersant (C) and the ash-free additive (B) combined therein and in addition, can be excellent in high-temperature detergency.

Not satisfying the requirement (X3), the lubricating oil composition cannot secure high-temperature detergency and base number retention.

In the lubricating oil composition of one embodiment of the present invention, the content of the boron atom derived from the boronated imide-type dispersant (C) is, from the viewpoint of more readily securing the advantageous effects of the present invention, preferably 400 to 2,000 ppm by mass, more preferably 600 to 1,500 ppm by mass, even more preferably 700 to 1,000 ppm by mass.

Examples of the boronated imide-type dispersant (C) include boron-modified products produced by boronating one or more compounds selected from succinic acid monoimides such as alkenylsuccinic acid monoimides and alkylsuccinic acid monoimides; and succinic acid bisimides such as alkenylsuccinic acid bisimides and alkylsuccinic acid bisimides.

Examples of the non-boronated imide-type dispersant (D) include one or more selected from the non-boronated compounds mentioned above for the boronated imide-type dispersant (C).

The alkenylsuccinic acid monoimide and the alkylsuccinic acid monoimide include compounds represented by the following general formula (d-1). The alkenylsuccinic acid bisimide and the alkylsuccinic acid bisimide include compounds represented by the following general formula (d-2).

(d-1)

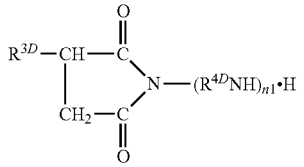

(d-2)

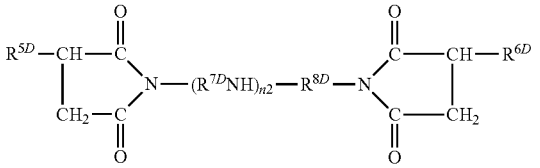

In the general formulae (d-1) and (d-2), $R^{3D}$, $R^{5D}$ and $R^{6D}$ each represent an alkenyl group or an alkyl group, each preferably having a weight-average molecular weight of 500 to 3,000, more preferably 1,000 to 3,000.

When the weight-average molecular weight of $R^{3D}$, $R^{5D}$ and $R^{6D}$ is 500 or more, the solubility of the compound in the base oil (A) is good. When it is 3,000 or less, the compound is expected to appropriately exhibit the effect to be attained by the compound. $R^{5D}$ and $R^{6D}$ may be the same or different.

$R^{4D}$, $R^{7D}$ and $R^{8D}$ each represent an alkylene group having 2 to 5 carbon atoms, and $R^{7D}$ and $R^{8D}$ may be the same or different. n1 represents an integer of 1 to 10, and n2 represents 0 or an integer of 1 to 10. Here, n1 is preferably 2 to 5, more preferably 2 to 4. When n1 is 2 or more, the boron-modified succinimide is expected to appropriately exhibit the effect to be attained by the compound. When n1 is 5 or less, the solubility of the compound in the base oil (A) is bettered more.

In the general formula (d-2), n2 is preferably 1 to 6, more preferably 2 to 6. When n2 is 1 or more, the compound is expected to appropriately exhibit the effect to be attained by the compound. When n2 is 6 or less, the solubility of the compound in the base oil (A) is bettered more.

The alkenyl group includes a polybutenyl group, a polyisobutenyl group, and an ethylene-propylene copolymer. The alkyl group includes ones prepared by hydrogenating these. Preferred alkenyl groups are a polybutenyl group and a polyisobutenyl group. The polybutenyl group is preferably one prepared by polymerizing a mixture of 1-butene and isobutene or a high-purity isobutene. Specific examples of preferred alkyl groups include those prepared by hydrogenating a polybutenyl group or a polyisobutenyl group.

For example, the boron-modified products of the above-mentioned succinimides can be produced by reacting a polyolefin and a maleic anhydride to give an alkenylsuccinic anhydride, then reacting a polyamine and a boron compound to give an intermediate, and reacting the alkenylsuccinic anhydride and the intermediate for imidation. The monoimide and the bisimide can be produced by changing the ratio of the alkenylsuccinic anhydride or the alkylsuccinic anhydride and the polyamine.

The boron-modified products of the above-mentioned succinimides can also be produced by processing a boron-free alkenyl, alkylsuccinic acid monoimide, alkenyl or alkylsuccinic acid bisimide with a boron compound.

As the olefin monomer to form the above-mentioned polyolefin, one or more α-olefins having 2 to 8 carbon atoms can be used either singly or as mixed, and a mixture of isobutene and 1-butene is preferably used.

On the other hand, the polyamine includes a simple diamine such as ethylenediamine, propylenediamine, butylenediamine and pentylenediamine; a polyalkylene polyamine such as diethylenetriamine, triethylenetetramine, tetraethylenepentamine, pentaethylenehexamine, di(methylethylene)triamine, dibutylenetriamine, tributylenetetramine and pentapentylenehexamine; and a piperazine derivative such as aminoethylpiperazine.

The boron compound includes a boric acid, a borate salt and a borate ester.

The boric acid includes orthoboric acid, metaboric acid and paraboric acid. The borate salt includes an ammonium borate such as ammonium metaborate, ammonium tetraborate, ammonium pentaborate, and ammonium octaborate. The borate ester includes monomethyl borate, dimethyl borate, trimethyl borate, monoethyl borate, diethyl borate, triethyl borate, monopropyl borate, dipropyl borate, tripropyl borate, monobutyl borate, dibutyl borate and tributyl borate.

The ratio of the boron atom amount to the nitrogen atom amount (B/N ratio) in the boron-modified succinimide is, from the viewpoint of reducing friction, preferably 0.6 or more by mass, more preferably 0.7 or more, even more preferably 0.8 or more. Not specifically limited, the B/N ratio is preferably 2.0 or less, more preferably 1.5 or less, even more preferably 1.3 or less.

(Content of Nitrogen Atom Derived from Non-Boronated Imide-Type Dispersant (D))

In the lubricating oil composition of one embodiment of the present invention, the content of the nitrogen atom derived from the non-boronated imide-type dispersant (D) is preferably 0.010 to 0.50% by mass based on the total amount of the lubricating oil composition, more preferably 0.025 to 0.25% by mass, even more preferably 0.050 to 0.20% by mass.

(Total Content of Nitrogen Atom Derived from Boronated Imide-Type Dispersant (C) and Nitrogen Atom Derived from Non-Boronated Imide-Type Dispersant (D))

In the lubricating oil composition of one embodiment of the present invention, the total content of the nitrogen atom derived from the boronated imide-type dispersant (C) and the nitrogen atom derived from the non-boronated imide-type dispersant (D) is preferably 0.0050 to 2.0% by mass based on the total amount of the lubricating oil composition, more preferably 0.010 to 1.0% by mass, even more preferably 0.050 to 0.40% by mass.

(Content of Boron Atom Derived from Boronated Imide-Type Dispersant (C) Relative to Total Content of Nitrogen Atom Derived from Boronated Imide-Type Dispersant (C) and Nitrogen Atom Derived from Non-Boronated Imide-Type Dispersant (D))

In the lubricating oil composition of one embodiment of the present invention, the content of the boron atom derived from the boronated imide-type dispersant (C) relative to the total content of the nitrogen atom derived from the boronated imide-type dispersant (C) and the nitrogen atom derived from the non-boronated imide-type dispersant (D) is, as a ratio by mass, preferably 0.10 to 1.0, more preferably 0.20 to 0.75, even more preferably 0.30 to 0.50.

<Metal-Based Detergent (E)>

The lubricating oil composition of one embodiment of the present invention may contain at least one metal-based detergent (E) selected from a calcium-based detergent (E1) and a magnesium-based detergent (E2), within a range satisfying the sulfated ash content as defined by the above-mentioned requirement (X1).

In the case where the lubricating oil composition of one embodiment of the present invention contains a metal-based detergent (E), the content of the metal atom derived from the metal-based detergent (E) is, from the viewpoint of satisfying the sulfated ash content as defined by the requirement (X1) and more readily securing the advantageous effects of the present invention, preferably 50 to 200 ppm by mass based on the total amount of the lubricating oil composition, more preferably 60 to 180 ppm by mass, even more preferably 70 to 160 ppm by mass, further more preferably 70 to 140 ppm by mass, further more preferably 70 to 120 ppm by mass.

In the lubricating oil composition of one embodiment of the present invention, the content of the metal-based detergent (E) may be so controlled that the content of the metal atom derived from the metal-based detergent (E) can fall within the above-mentioned range. The content of the metal-based detergent (E) is preferably 0.05% by mas or more based on the total amount of the lubricating oil composition, more preferably 0.06% by mass or more, even more preferably 0.07% by mass or more, and is preferably 0.10% by mass or less.

However, from the viewpoint of reducing the sulfated ash content in the lubricating oil composition of one embodiment of the present invention, the content of the metal atom derived from the metal-based detergent (E) therein is preferably less than 50 ppm by mass, more preferably less than 10 ppm by mass, even more preferably 1 ppm by mass, further more preferably 0.1 ppm by mass. Still further more preferably, the lubricating oil composition does not contain the metal-based detergent (E). Even when the sulfated ash content in the lubricating oil composition of the present invention is 0.02% by mass or less and is extremely low, not containing the metal-based detergent (E), viscosity increase can be suppressed and high-temperature detergency and base number retention can be improved.

(Calcium-Based Detergent (E1))

Examples of the calcium-based detergent (E1) include calcium salts such as a calcium sulfonate, a calcium phenate and a calcium salicylate.

Among these, from the viewpoint of bettering high-temperature detergency, a calcium phenate and a calcium salicylate are preferred, and a calcium salicylate is more preferred.

As the calcium sulfonate, preferred is a compound which is a metal sulfonate represented by the following general formula (e1-1) where M is a calcium atom. As the calcium phenate, preferred is a compound which is a metal phenate represented by the following general formula (e1-2) where M' is a calcium atom. As the calcium salicylate, preferred is a compound which is a metal salicylate represented by the following general formula (e1-3) where M is a calcium atom.

One alone or two or more kinds of calcium-based detergents (E1) can be used either singly or as combined.

(e1-1)

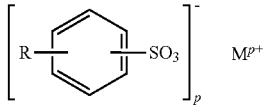

-continued (e1-2)

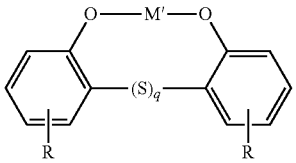

(e1-3)

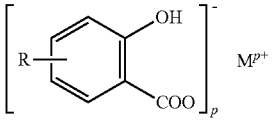

In the general formulae (e1-1) to (e1-3), M represents a metal atom selected from an alkali metal and an alkaline earth metal, M' represents an alkaline earth metal. p represents a valence of M, and is 1 or 2. R represents a hydrogen atom, or a hydrocarbon group having 1 or more and 18 or less carbon atoms. q represents an integer of 0 or more, and is preferably an integer of 0 or more and 3 or less.

Examples of the hydrocarbon group that can be selected for R include an alkyl group having 1 or more and 18 or less carbon atoms, an alkenyl group having 1 or more and 18 or less carbon atoms, a cycloalkyl group having 3 or more and 18 or less ring carbon atoms, an aryl group having 6 or more and 18 or less ring carbon atoms, an alkylaryl group having 7 or more and 18 or less carbon atoms, and an arylalkyl group having 7 or more and 18 or less carbon atoms.

The calcium-based detergent (E1) may be neutral, basic or overbased, but is, from the viewpoint of more readily improving base number retention, preferably basic or overbased, more preferably overbased.

In the present specification, a basic or overbased metal-based detergent means a product produced by reacting a metal and an acidic organic compound and containing a metal in an amount more than the stoichiometric amount necessary for neutralization of the acidic organic compound with the metal. Namely, when a total chemical equivalent of the metal in a metal-based detergent, relative to the chemical equivalent of the metal in a metal salt (neutral salt) produced by reaction according to the stoichiometric amount necessary for neutralization of a metal and an acidic organic compound is referred to as "metallic ratio", the metallic ratio of a basic or overbased metal-based detergent is more than 1. The metallic ratio of the basic or overbased metal-based detergent for use in the present embodiment is preferably more than 1.3, more preferably 5 to 30, even more preferably 7 to 22. Specific examples of the basic or overbased metal-based detergent include those containing one or more selected from the group consisting of the above-mentioned metal salicylate, metal phenate and metal sulfonate and containing an excessive metal.

In the present specification, those having a base number, as measured according to the measurement method to be mentioned hereinunder, of less than 50 mgKOH/g are defined to be "neutral"; those having a base number of 50 mgKOH/g or more and less than 150 mgKOH/g are "basic"; and those having a base number of 150 mgKOH/g or more are "overbased".

In the case where the calcium-based detergent (E1) is a calcium sulfonate, the base number of the calcium sulfonate is preferably 5 mgKOH/g or more, more preferably 100 mgKOH/g or more, even more preferably 150 mgKOH/g or more, further more preferably 250 mgKOH/g or more, and is preferably 500 mgKOH/g or less, more preferably 450 mgKOH/g or less, even more preferably 400 mgKOH/g or less.

In the case where the calcium-based detergent (E1) is a calcium phenate, the base number of the calcium phenate is preferably 50 mgKOH/g or more, more preferably 100 mgKOH/g or more, even more preferably 150 mgKOH/g or more, further more preferably 200 mgKOH/g or more, and is preferably 500 mgKOH/g or less, more preferably 450 mgKOH/g or less, even more preferably 400 mgKOH/g or less.

In the case where the calcium-based detergent (E1) is a calcium salicylate, the base number of the calcium salicylate is preferably 50 mgKOH/g or more, more preferably 100 mgKOH/g or more, even more preferably 150 mgKOH/g or more, further more preferably 200 mgKOH/g or more, and is preferably 500 mgKOH/g or less, more preferably 450 mgKOH/g or less, even more preferably 400 mgKOH/g or less.

In the present specification, the "base number" of the metal-based detergent (E) means a base number measured by a perchloric acid method according to JIS K 2501:2003.

In the case where the lubricating oil composition of one embodiment of the present invention contains a calcium-based detergent (E1), the content of the calcium atom derived from the calcium-based detergent (E1) is, from the viewpoint of more readily improving base number retention while satisfying the requirement for the sulfated ash content as defined by the requirement (X1), preferably 50 to 200 ppm by mass based on the total amount of the lubricating oil composition, more preferably 60 to 180 ppm by mass, even more preferably 70 to 160 ppm by mass, further more preferably 70 to 140 ppm by mass, further more preferably 70 to 120 ppm by mass.

In the lubricating oil composition of one embodiment of the present invention, the content of the calcium-based detergent (E1) may be so controlled that the content of the calcium atom derived from the calcium-based detergent (E1) can fall within the above-mentioned range. The content of the calcium-based detergent (E1) is preferably 0.05% by mass or more based on the total amount of the lubricating oil composition, more preferably 0.06% by mass or more, even more preferably 0.07% by mass or more, and is preferably 0.10% by mass or less.

Here, in the lubricating oil composition of one embodiment of the present invention, the content of the calcium atom derived from the calcium-based detergent (E1) is, from the viewpoint of reducing the sulfated ash content, preferably less than 50 ppm by mass, more preferably less than 10 ppm by mass, even more preferably less than 1 ppm by mass, further more preferably less than 0.1 ppm by mass. Still further more preferably, the composition does not contain the calcium-based detergent (E1). Even when the sulfated ash content in the lubricating oil composition of the present invention is 0.02% by mass or less and is extremely low, not containing the calcium-based detergent (E1), viscosity increase can be suppressed and high-temperature detergency and base number retention can be improved.

(Magnesium-Based Detergent (E2))

Examples of the magnesium-based detergent (E2) include magnesium salts such as a magnesium sulfonate, a magnesium phenate and a magnesium salicylate.

Among these, from the viewpoint of bettering high-temperature detergency, a magnesium sulfonate is preferred.

As the magnesium sulfonate, preferred is a compound which is a metal sulfonate represented by the above-mentioned general formula (e1-1) where M is a magnesium atom. As the magnesium phenate, preferred is a compound which is a metal phenate represented by the general formula (e1-2) where M' is a magnesium atom. As the magnesium salicylate, preferred is a compound which is a metal salicylate represented by the general formula (e1-3) where M is a magnesium atom.

One alone or two or more kinds of magnesium-based detergents (E2) can be used either singly or as combined.

The magnesium-based detergent (E2) may be neutral, basic or overbased, but is, from the viewpoint of detergency, preferably basic or overbased.

In the case where the magnesium-based detergent (E2) is a magnesium sulfonate, the base number of the magnesium sulfonate is preferably 5 mgKOH/g or more, more preferably 100 mgKOH/g or more, even more preferably 300 mgKOH/g or more, further more preferably 350 mgKOH/g or more, and is preferably 650 mgKOH/g or less, more preferably 500 mgKOH/g or less, even more preferably 450 mgKOH/g or less.

In the case where the magnesium-based detergent (E2) is a magnesium salicylate, the base number of the magnesium salicylate is preferably 50 mgKOH/g or more, more preferably 100 mgKOH/g or more, even more preferably 200 mgKOH/g or more, further more preferably 300 mgKOH/g or more, and is preferably 500 mgKOH/g or less, more preferably 450 mgKOH/g or less, even more preferably 400 mgKOH/g or less.

In the case where the magnesium-based detergent (E2) is a magnesium phenate, the base number of the magnesium phenate is preferably 50 mgKOH/g or more, more preferably 100 mgKOH/g or more, even more preferably 200 mgKOH/g or more, and is preferably 500 mgKOH/g or less, more preferably 450 mgKOH/g or less, even more preferably 400 mgKOH/g or less.

In the lubricating oil composition of one embodiment of the present invention, the content of the magnesium atom derived from the magnesium-based detergent (E2) is, from the viewpoint of more readily improving base number retention while satisfying the requirement for the sulfated ash content as defined by the requirement (X1), preferably 50 to 200 ppm by mass based on the total amount of the lubricating oil composition, more preferably 60 to 180 ppm by mass, even more preferably 70 to 160 ppm by mass, further more preferably 70 to 140 ppm by mass, further more preferably 70 to 120 ppm by mass.

In the lubricating oil composition of one embodiment of the present invention, the content of the magnesium-based detergent (E2) may be so controlled that the content of the magnesium atom derived from the magnesium-based detergent (E2) can fall within the above-mentioned range. The content of the magnesium-based detergent (E2) is preferably 0.05% by mass or more based on the total amount of the lubricating oil composition, more preferably 0.06% by mass or more, even more preferably 0.07% by mass or more, and is preferably 0.10% by mass or less.

Here, in the lubricating oil composition of one embodiment of the present invention, the content of the magnesium atom derived from the magnesium-based detergent (E2) is, from the viewpoint of reducing the sulfated ash content, preferably less than 50 ppm by mass, more preferably less than 10 ppm by mass, even more preferably less than 1 ppm by mass, further more preferably less than 0.1 ppm by mass. Still further more preferably, the composition does not contain the magnesium-based deter gent (E2). Even when the sulfated ash content in the lubricating oil composition of the present invention is 0.02% by mass or less and is extremely low, not containing the magnesium-based detergent (E2), viscosity increase can be suppressed and high-temperature detergency and base number retention can be improved.

<Zinc Dithiophosphate (F)>

The lubricating oil composition of one embodiment of the present invention may contain a zinc dithiophosphate (F) within the range satisfying the sulfated ash content as defined by the above-mentioned requirement (X1).

Containing a zinc dithiophosphate (F), oxidation stability of the lubricating oil composition of one embodiment of the present invention can be improved more.

In the lubricating oil composition of one embodiment of the present invention, the content of phosphorus atom derived from the zinc dithiophosphate (F) is, from the viewpoint of more readily improving the oxidation stability of the lubricating oil composition while satisfying the requirement for the sulfated ash content as defined by the requirement (X1), preferably 50 to 300 ppm by mass based on the total amount of the lubricating oil composition, more preferably 70 to 280 ppm by mass, even more preferably 80 to 260 ppm by mass.

In the lubricating oil composition of one embodiment of the present invention, the content of zinc dithiophosphate (F) may be so controlled that the content of the phosphorus atom derived from the zinc dithiophosphate (F) can fall within the above-mentioned range. The content of the zinc dithiophosphate (F) is preferably 0.05% by mass or more based on the total amount of the lubricating oil composition, more preferably 0.08% by mass or more, even more preferably 0.10% by mass or more, and is preferably 1.00% by mass or less.

The zinc dithiophosphate (F) for use in the lubricating oil composition of one embodiment of the present invention is preferably one represented by the following general formula (f-1).

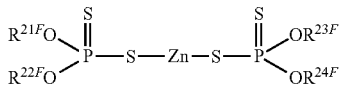

(f-1)

In the general formula (f-1), $R^{21F}$ to $R^{24F}$ each independently represent a hydrocarbon group. With no specific limitation, the hydrocarbon group may be any monovalent hydrocarbon group, and is, from the viewpoint of improving oxidation stability, preferably an alkyl group, an alkenyl group, a cycloalkyl group, an aryl group or the like, and more preferably an alkyl group or an aryl group. Namely, the zinc dithiophosphate for use in one embodiment of the present invention is more preferably a zinc dialkyldithiophosphate or a zinc diaryldithiophosphate.

The alkyl group and the alkenyl group for $R^{21F}$ to $R^{24F}$ may be linear or branched but is, from the viewpoint of attaining more excellent oxidation stability, preferably a primary or secondary one, more preferably a primary alkyl group or a secondary alkyl group, even more preferably a secondary alkyl group. Specifically, above all, the zinc dialkyldithiophosphate for use in the present embodiment is preferably a zinc primary dialkyldithiophosphate or a zinc secondary dialkyldithiophosphate, even more preferably a zinc secondary dialkyldithiophosphate.

Regarding the carbon number of the hydrocarbon group of $R^{21F}$ to $R^{24F}$, when the monovalent hydrocarbon group is an alkyl group, the carbon number thereof is, from the viewpoint of improving oxidation stability, preferably 1 or more, more preferably 2 or more, even more preferably 3 or more, and the upper limit is preferably 24 or less, more preferably 18 or less, even more preferably 12 or less. When the monovalent hydrocarbon group is an alkenyl group, the carbon umber thereof is preferably 2 or more, more preferably 3 or more, and the upper limit is 24 or less, more preferably 18 or less, even more preferably 12 or less.

The cycloalkyl group and the aryl group of $R^{21F}$ to $R^{24F}$ may be a polycyclic group such as a decalyl group or a naphthyl group. Regarding the carbon number of the hydrocarbon group of $R^{21F}$ to $R^{24F}$, when the monovalent hydrocarbon group is a cycloalkyl group, the carbon number thereof is preferably 5 or more, and the upper limit is preferably 20 or less. When the monovalent hydrocarbon group is an aryl group, the carbon umber thereof is preferably 6 or more, and the upper limit is 20 or less.

The monovalent hydrocarbon group may be partly substituted with a group containing an oxygen atom and/or a nitrogen atom, such as a hydroxy group, a carboxy group, an amino group, an amide group, a nitro group or a cyano group, and may be partly substituted with a nitrogen atom, an oxygen atom or a halogen atom. When the monovalent hydrocarbon group is a cycloalkyl group or an aryl group, the group may further has a substituent such as an alkyl group and an alkenyl group.

<Other Additive for Lubricating Oil>

The lubricating oil composition of one embodiment of the present invention may contain any other additive for lubricating oil than the above-mentioned component (B), component (C), component (D), component (E) and component (F), within a range not detracting from the advantageous effects of the present invention.

Examples of the other additive for lubricating oil include a non-sulfur antioxidant and a metal deactivator.

One alone or two or more kinds of these additives for lubricating oil may be used either singly or as combined.

The content of each of these additives for lubricating oil may be appropriately controlled within a range not detracting from the advantageous effects of the present invention, and is, in general, each independently 0.001 to 15% by mass based on the total amount (100% by mass) of the lubricating oil composition, preferably 0.005 to 10% by mass, more preferably 0.01 to 8% by mass, even more preferably 0.1 to 6% by mass.

(Non-Sulfur Antioxidant)

As the non-sulfur antioxidant, a phenolic antioxidant and an amine antioxidant are preferably used, and preferably, a phenolic antioxidant and an amine antioxidant are used as combined.

As the phenolic antioxidant, any one can be appropriately selected from known phenolic antioxidants heretofore used as antioxidants for lubricating oil compositions for gas engines and used, and examples thereof include a monophenolic antioxidant such as an alkylphenol antioxidant such as 2,6-di-t-butyl-4-methylphenol, 2,6-di-t-butyl-4-ethylphenol, and octadecyl 3-(3,5-di-t-butyl-4-hydroxyphenyl)propionate; a diphenolic antioxidant such as 4,4'-methylenebis(2,6-di-t-butylphenol), and 2,2'-methylenebis(4-ethyl-6-t-butylphenol); and a hindered phenol antioxidant.

As the amine antioxidant, any one can be appropriately selected from known amine antioxidants heretofore used as antioxidants for lubricating oil compositions for gas engines and used, and examples thereof include a diphenylamine antioxidant such as a diphenylamine, and an alkylated diphenylamine having an alkyl group having 3 to 20 carbon atoms; and a naphthylamine antioxidant such as an α-naphthylamine, and a $C_3$ to $C_{20}$ alkyl-substituted phenyl-α-naphthylamine.

(Metal Deactivator)

Examples of the metal deactivator include a benzotriazole compound, a tolyltriazole compound, an imidazole compound, and a pyrimidine compound. One alone or two or more kinds of these may be used either singly or as combined.

[Characteristics of Lubricating Oil Composition]

<Kinematic Viscosity, Viscosity Index>

The 100° C. kinematic viscosity of the lubricating oil composition of one embodiment of the present invention is preferably 2 to 20 $mm^2/s$, more preferably 3 to 15 $mm^2/s$, even more preferably 4 to 12 $mm^2/s$.

From the viewpoint of suppressing viscosity change accompanied by temperature change and from the viewpoint of improving fuel efficiency, the viscosity index of the lubricating oil composition of one embodiment of the present invention is preferably 80 or more, more preferably 90 or more, even more preferably 100 or more.

In the present specification, the 100° C. kinematic viscosity and the viscosity index mean values measured or calculated according to JIS K 2283:2000.

<100° C. Kinematic Viscosity Ratio in NOx-ISOT Test>

In a NOx-ISOT test as carried out according to the method described in the section of Examples given hereinunder, the 100° C. kinematic viscosity ratio of the lubricating oil composition of one embodiment of the present invention is preferably 2.0 or less, more preferably 1.8 or less, even more preferably 1.6 or less, further more preferably 1.5 or less, further more preferably 1.4 or less, further more preferably 1.3 or less. The 100° C. kinematic viscosity ratio in the NOx-ISOT test is theoretically 1.0 or more.

<Lifetime in NOx-ISOT Test>

In the NOx-ISOT test as carried out according to the method described in the section of Examples given hereinunder, the lifetime of the lubricating oil composition of one embodiment of the present invention is preferably 70 hours or more, more preferably 80 hours or more, even more preferably 90 hours or more, further more preferably 100 hours or more, further more preferably 110 hours or more, further more preferably 120 hours or more, further more preferably 130 hours or more. In general, the lifetime is 1,000 hours or less.

<Merit Score in Hot Tube Test>

In a hot tube test (300° C.) as carried out according to the method described in the section of Examples given hereinunder, the merit score of the lubricating oil composition of one embodiment of the present invention is preferably 2.0 or more, more preferably 2.5 or more, even more preferably 3.0 or more, further more preferably 3.5 or more, and is generally less than 10.0.

<Content of Atoms>

In the lubricating oil composition of the present invention, the boron atom content is 200 ppm by mass or more based on the total amount of the lubricating oil composition. In the lubricating oil composition of one embodiment of the present invention, the boron atom content is preferably 400 to 2,000 ppm by mass based on the total amount of the lubricating oil composition, more preferably 600 to 1,500 ppm by mass, even more preferably 700 to 1,000 ppm by mass.

In the lubricating oil composition of one embodiment of the present invention, the calcium atom content is preferably 50 to 200 ppm by mass based on the total amount of the lubricating oil composition, more preferably 60 to 180 ppm by mass, even more preferably 70 to 160 ppm by mass, further more preferably 70 to 140 ppm by mass, further more preferably 70 to 120 ppm by mass. Also in the lubricating oil composition of one embodiment of the present invention, the calcium atom content is, from the viewpoint of reducing the sulfated ash content, preferably less than 50 ppm by mass, more preferably less than 10 ppm by mass, even more preferably less than 1 ppm by mass, further more preferably less than 0.1 ppm by mass. Even further more preferably, the composition does not contain a calcium atom.

In the lubricating oil composition of one embodiment of the present invention, the magnesium atom content is preferably 50 to 200 ppm by mass based on the total amount of the lubricating oil composition, more preferably 60 to 180 ppm by mass, even more preferably 70 to 160 ppm by mass, further more preferably 70 to 140 ppm by mass, further more preferably 70 to 120 ppm by mass. Also in the lubricating oil composition of one embodiment of the present invention, the magnesium atom content is, from the viewpoint of reducing the sulfated ash content, preferably less than 50 ppm by mass, more preferably less than 10 ppm by mass, even more preferably less than 1 ppm by mass, further more preferably less than 0.1 ppm by mass. Even further more preferably, the composition does not contain a magnesium atom.

In the lubricating oil composition of one embodiment of the present invention, the phosphorus atom content is preferably 50 to 300 ppm by mass based on the total amount of the lubricating oil composition, more preferably 70 to 280 ppm by mass, even more preferably 80 to 260 ppm by mass.

The content of the boron atom, the calcium atom, the magnesium atom and the phosphorus atom in the lubricating oil composition is a value measured according to JPI-5S-38-03.

[Use of Lubricating Oil Composition]

The lubricating oil composition of the present invention can suppress viscosity increase and is excellent in high-temperature detergency and base number retention even in the same environment as that for gas engines that undergo high-temperature oxidation degradation and NOx degradation.

Consequently, the lubricating oil composition of the present invention can be favorably used for gas engines, and in particular, can be favorably used for gas generation systems and gas heat pump systems.

Accordingly, the present invention also provides a gas engine shown in the following (1), a system shown in the following (2), and use methods shown in (3) and (4).

(1) A gas engine having a lubricating oil composition for gas engines of the present invention.

(2) A gas cogeneration system or a gas heat pump system equipped with a gas engine having a lubricating oil composition for gas engines of the present invention.

(3) A use method of using a lubricating oil composition for gas engines of the present invention for lubrication of gas engines.

(4) A use method of using a lubricating oil composition for gas engines of the present invention for lubrication of a gas engine equipped in a gas cogeneration system or a gas heat pump system.

The lubricating oil composition of the present invention is excellent in the effect of suppressing viscosity increase and in high-temperature detergency and base number retention, and is therefore excellent in durability.

[Production Method for Lubricating Oil Composition]

A production method for the lubricating oil composition of the present invention is not specifically limited.

For example, a production method for the lubricating oil composition of one embodiment of the present invention includes a step of preparing a lubricating oil composition containing the base oil (A), the component (B) and the component (C), and the preparation is carried out so as to satisfy the following requirements (X1) to (X3).

Requirement (X1): the sulfated ash content is 0.2% by mass or less.

Requirement (X2): the content of the ash-free additive (B) is 1.2% by mass or less based on the total amount of the lubricating oil composition, provided that in the case where the ash-free additive (B) contains the hindered amine compound (B2), the content of the hindered amine compound (B2) is less than 1.0% by mass based on the total amount of the lubricating oil composition.

Requirement (X3): the content of the boron atom derived from the boronated imide-type dispersant (C) is 200 ppm by mass or more based on the total amount of the lubricating oil composition.

The method of mixing the above-mentioned components is not specifically limited, and one example thereof includes a step of blending the base oil (A) with the component (B) and the component (C). Along with the components (A) to (C), the components (D) to (F) and further other additives for lubricating oil may also be blended simultaneously. Each component may be blended in the form of a solution (dispersion) added with a diluent oil or the like. After blended, preferably, the components are uniformly dispersed by stirring according to a known method.

EXAMPLES

Hereinunder the present invention is described more specifically with reference to Examples, but the present invention is by no means limited by these Examples.

[Determination of Various Properties]

In the present specification, various properties of the raw materials used in Examples and Comparative Examples and the lubricating oil compositions of Examples and Comparative Examples were those determined according to the following procedures.

<100° C. Kinematic Viscosity, Viscosity Index>

Measured or calculated using a glass-made capillary viscometer according to JIS K2283-2000.

<Atom Content in Lubricating Oil Composition>

The content of the boron atom, the phosphorus atom, the calcium atom and the magnesium atom in the lubricating oil composition was measured according to JIS-5S-38-03.

<Sulfated Ash Content>

Measured according to JIS K2272-1998.

Examples 1 to 13 and Comparative Examples 1 to 3

The raw materials shown below (base oil and various additives) were blended in the blending ratio (unit:% by mass) shown in Table 1 and Table 2, and fully mixed to prepare lubricating oil compositions.

Details of the raw materials used in Examples 1 to 13 and Comparative Examples 1 to 3 are as shown below.

<Base Oil (A)>

A mixed base oil of the following mineral base oil A-1 and mineral base oil A-2 was used.

Mineral base oil A-1: mineral base oil grouped in Group 2 in the API category, having a 100° C. kinematic viscosity of 5.3 $mm^2/s$.

Mineral base oil A-2: mineral base oil grouped in Group 2 in the API category, having a 100° C. kinematic viscosity of 10.7 $mm^2/s$.

<Sulfur-Based Antioxidant (B1)>

Thiocarbamate compound B1-1: methylene bis(dibutyldithiocarbamate). Sulfur-containing triazine compound B1-2: 2,6-di-tert-butyl-4-(4,6-bis(octylthio)-1,3,5-triazin-2-ylamino)phenol.

<Hindered Amine Compound (B2)>

Hindered amine compound B2-1: hindered amine compound having two piperidine-derived skeletons (bishindered amine compound, nitrogen content: 5.3% by mass), a compound of the above-mentioned general formula (b2-1d) where n=8 and $R^{21B}$ is a methyl group.

Hindered amine compound B2-2: hindered amine compound having one piperidine-derived skeleton (monohindered amine compound, nitrogen content: 4.2% by mass), a compound of the above-mentioned general formula (b2-1c) where $R^{21B}$ is a hydrogen atom and R' is $—C_{11}H_{23}$.

<Boronated Imide-Type Dispersant (C), Non-Boronated Imide-Type Dispersant (D)>

Boronated imide-type dispersant (C): boron content 1.3% by mass, nitrogen content 1.2% by mass.

Non-boronated imide-type dispersant (D): nitrogen content 1.9% by mass.

<Metal-Based Detergent (E)>

Calcium-based detergent E1-1: Ca sulfonate (Ca content: 11.7% by mass, base number: 300 mgKOH/g).

Calcium-based detergent E1-2: Ca phenate (Ca content: 8.8% by mass, base number: 250 mgKOH/g).

Calcium-based detergent E1-3: Ca salicylate (Ca content: 12.5% by mass, base number: 350 mgKOH/g).

Magnesium-based detergent E2: Mg sulfonate (Mg content: 9.5% by mass, base number: 395 mgKOH/g).

The base number of the metal-based detergent (E) is a base number measured by a perchloric acid method according to JIS K 2501:2003.

<Zinc Dithiophosphate (F)>

Zinc dithiophosphate F-1: zinc secondary dialkyldithiophosphate (sec-ZnDTP) (Zn content: 8.8% by mass, P content: 8.1% by mass).

Zinc dithiophosphate F-2: zinc diaryldithiophosphate (Aryl-ZnDTP) (Zn content: 3.1% by mass, P content: 2.7% by mass).

<Other Additives for Lubricating Oil>

An amine antioxidant, a phenolic antioxidant, and a metal deactivator were blended in the blending ratio shown in Table 1 and Table 2. The blending ratio is a blending ratio based on the total amount of the lubricating oil composition.

[Evaluation Methods]

The lubricating oil compositions of Examples and Comparative Examples were evaluated according to the following methods.

<Evaluation of 100° C. Kinematic Viscosity Ratio in NOx-ISOT Test>

Air (flow rate: 150 mL/min) was mixed with a gas prepared by diluting nitrogen monoxide (NO) with nitrogen (NO concentration: 8,000 ppm by volume, flow rate 50 mL/min), and introduced into 250 g of a sample at an oil temperature of 150° C. to prepare an NOx-degraded oil taking 240 hours.

The 100° C. kinematic viscosity of the NOx-degraded oil was measured using the same method as that of the above-mentioned method, and the 100° C. kinematic viscosity ratio was calculated according to the following formula.

(100° C. kinematic viscosity ratio)=(100° C. kinematic viscosity of NOx-degraded oil)/(100° C. kinematic viscosity of sample oil before degradation)

The samples having a 100° C. kinematic viscosity ratio of 2.0 or less in the NOx-ISOT test were considered good.

<Evaluation of Lifetime in NOx-ISOT Test>

Air (flow rate: 150 mL/min) was mixed with a gas prepared by diluting nitrogen monoxide (NO) with nitrogen (NO concentration: 8,000 ppm by volume, flow rate 50 mL/min), and introduced into 250 g of a sample at an oil temperature of 150° C. to prepare an NOx-degraded oil. The base number of the NOx-degraded oil was measured by a hydrochloric acid potentiometric titration method according to JIS K2501:2003, and the time taken until the hydrochloric acid method base number could reach 1.0 mgKOH/g (NOx-ISOT lifetime, unit: hour) was measured.

The samples having a lifetime in the NOx-ISOT test of 70 hours or more were considered good.

<Hot Tube Test (HTT)>

Carried out based on JPI-5S-55-99.

Specifically, into a glass tube having an inner diameter of 2 mm kept at a temperature of 300° C., a lubricating oil composition was kept introduced at a rate of 0.3 mL/hr and air at a rate of 10 mL/min for 16 hours. The lacquer adhered to the glass tube was compared with a color sample, and the glass tube was graded one to ten at intervals of 0.5 points in such a manner that a transparent tube was given 10 points and a black tube was given 0 point. The samples given a larger point can be said to be a lubricating oil composition more excellent in high-temperature detergency.

The results are shown in Table 1 and Table 2.

The lubricating oil compositions of Examples and Comparative Examples do not substantially contain a boron atom except the boron atom derived from the boronated imide-type dispersant (C), a phosphorus atom except the phosphorus atom derive from the zinc dithiophosphate (F), a calcium atom except the calcium atom derived from the metal-based detergent (E), and a magnesium atom except the magnesium atom derived from the metal-based detergent (E). Therefore, the content of the boron atom, the phosphorus atom, the calcium atom and the magnesium atom in the lubricating oil compositions shown in Table 1 and Table 2 each corresponds to the content of the boron atom derived from the boronated imide-type dispersant (C), the content of the phosphorus atom derived from the zinc dithiophosphate (F), the content of the calcium atom derived from the metal-based detergent (E) and the content of the magnesium atom derived from the metal-based detergent (E), respectively.

Consequently, in Table 1 and Table 2, the content of the boron atom, the phosphorus atom, the calcium atom and the magnesium atom in the lubricating oil composition contained in the lubricating oil composition is described as the content of the boron atom derived from the boronated imide-type dispersant (C), the content of the phosphorus atom derived from the zinc dithiophosphate (F), the content of the calcium atom derived from the metal-based detergent (E) and the content of the magnesium atom derived from the metal-based detergent (E), respectively.

Also in Table 1 and Table 2, in the case where the phosphorus atom content is "10>", the phosphorus atom content is less than the measurable limits, which means that a phosphorus atom is not substantially contained. Similarly, also in the case where the calcium atom content and the magnesium atom content are "2>", the calcium atom content and the magnesium atom content are less than the measurable limits, meaning that a calcium atom and a magnesium atom are not substantially contained.

In Examples and Comparative Examples, the total content of the nitrogen atom derived from the boronated imide-type dispersant (C) and the nitrogen atom derived from the non-boronated imide-type dispersant (D) is as follows.

Examples 1 to 3, Examples 5 to 13, Comparative Example 1, and Comparative Example 3: 0.19% by mass Example 4: 0.18% by mass Comparative Example 2: 0.13% by mass In Examples and Comparative Examples, the content of the boron atom derived from the boronated imide-type dispersant (C) relative to the total content of the nitrogen atom derived from the boronated imide-type dispersant (C) and the nitrogen atom derived from the non-boronated imide-type dispersant (D) is as follows.

Examples 1 to 3, Examples 5 to 13, Comparative Example 1, and Comparative Example 3: 0.45

Example 4: 0.92

Comparative Example 2: 0.078

TABLE 1

| | | | Example 1 | Example 2 | Example 3 | Example 4 |
|---|---|---|---|---|---|---|
| Base Oil (A) | Mineral Base Oil A-1 | mass % | 47.14 | 47.14 | 47.14 | 47.14 |
| | Mineral Base Oil A-2 | mass % | 37.61 | 37.81 | 37.91 | 36.11 |
| Ash-free Additive (B) | Sulfur-based Antioxidant (B1):thiocarbamate compound B1-1 | mass % | 0.40 | 0.40 | 0.80 | 1.00 |
| | Sulfur-based Antioxidant (B1):sulfur-containing triazine compound B1-2 | mass % | — | — | — | — |
| | Hindered Amine Compound B2-1 (number of piperidine-derived skeletons: 2) | mass % | 0.50 | 0.50 | — | — |
| | Hindered Amine Compound B2-2 (number of piperidine-derived skeleton: 1) | mass % | — | | — | — |
| Boronated Imide-type Dispersant (C) | | mass % | 6.00 | 6.00 | 6.00 | 11.60 |
| Non-boronated Imide-type Dispersant (D) | | mass % | 6.30 | 6.30 | 6.30 | 2.30 |
| Metal-based Detergent (E) | Calcium-based Detergent E1-1: Ca sulfonate | mass % | 0.08 | — | — | — |
| | Calcium-based Detergent E1-2: Ca phenate | mass % | — | — | — | — |
| | Calcium-based Detergent E1-3: Ca salicylate | mass % | — | — | — | — |
| | Magnesium-based Detergent E2: Mg sulfonate | mass % | — | — | — | — |
| Zinc Dithiophosphate (F) | Zinc Dithiophosphate F-1: Sec ZnDTP | mass % | 0.12 | — | — | — |
| | Zinc Dithiophosphate F-2: Aryl ZnDTP | mass % | — | — | — | — |
| Other Additive for lubricating oil | | mass % | 1.85 | 1.85 | 1.85 | 1.85 |
| Total | | mass % | 100.00 | 100.00 | 100.00 | 100.00 |
| Content of boron atom derived from boronated imide-type dispersant (C) | | ppm by mass | 860 | 860 | 860 | 1660 |
| Content of phosphorus atom derived from zinc dithiophosphate (F) | | ppm by mass | 100 | 10> | 10> | 10> |
| Content of calcium atom derived from metal-based detergent (E) | | ppm by mass | 90 | 2> | 2> | 2> |
| Content of magnesium atom derived from metal-based detergent (E) | | ppm by mass | 2> | 2> | 2> | 2> |
| Sulfated Ash Content | | mass % | 0.09 | 0.02 | 0.02 | 0.02 |
| Viscosity Index | | | 111 | 111 | 111 | 114 |
| Evaluation Results | NOx-ISOT 240 hr 100° C. Kinematic Viscosity Ratio (viscosity increase suppressing effect) | | 1.4 | 1.5 | 1.3 | 1.3 |
| | NOx-ISOT Lifetime (unit: hour) (base number retention) | | 146 | 102 | 108 | 110 |
| | Hot Tube Test 300° C. Merit Score (high-temperature detergency) | | 2.0 | 2.0 | 3.5 | 7.0 |

| | | | Example 5 | Example 6 | Example 7 | Example 8 |
|---|---|---|---|---|---|---|
| Base Oil (A) | Mineral Base Oil A-1 | mass % | 47.14 | 47.14 | 47.14 | 47.14 |
| | Mineral Base Oil A-2 | mass % | 38.21 | 37.31 | 38.21 | 38.01 |
| Ash-free Additive (B) | Sulfur-based Antioxidant (B1):thiocarbamate compound B1-1 | mass % | — | — | — | 0.40 |
| | Sulfur-based Antioxidant (B1):sulfur-containing triazine compound B1-2 | mass % | — | — | — | — |
| | Hindered Amine Compound B2-1 (number of piperidine-derived skeletons: 2) | mass % | 0.50 | 0.50 | — | 0.30 |
| | Hindered Amine Compound B2-2 (number of piperidine-derived skeleton: 1) | mass % | — | — | 0.50 | — |
| Boronated Imide-type Dispersant (C) | | mass % | 6.00 | 6.00 | 6.00 | 6.00 |
| Non-boronated Imide-type Dispersant (D) | | mass % | 6.30 | 6.30 | 6.30 | 6.30 |
| Metal-based Detergent (E) | Calcium-based Detergent E1-1: Ca sulfonate | mass % | — | — | — | — |
| | Calcium-based Detergent E1-2: Ca phenate | mass % | — | — | — | — |
| | Calcium-based Detergent E1-3: Ca salicylate | mass % | — | — | — | — |
| | Magnesium-based Detergent E2: Mg sulfonate | mass % | — | — | — | — |
| Zinc Dithiophosphate (F) | Zinc Dithiophosphate F-1: Sec ZnDTP | mass % | — | — | — | — |
| | Zinc Dithiophosphate F-2: Aryl ZnDTP | mass % | — | 0.90 | — | — |
| Other Additive for lubricating oil | | mass % | 1.85 | 1.85 | 1.85 | 1.85 |
| Total | | mass % | 100.00 | 100.00 | 100.00 | 100.00 |
| Content of boron atom derived from boronated imide-type dispersant (C) | | ppm by mass | 860 | 860 | 860 | 860 |

TABLE 1-continued

| | | | | | | |
|---|---|---|---|---|---|---|
| Content of phosphorus atom derived from zinc dithiophosphate (F) | | ppm by mass | 10> | 250 | 10> | 10> |
| Content of calcium atom derived from metal-based detergent (E) | | ppm by mass | 2> | 2> | 2> | 2> |
| Content of magnesium atom derived from metal-based detergent (E) | | ppm by mass | 2> | 2> | 2> | 2> |
| Sulfated Ash Content | | mass % | 0.02 | 0.14 | 0.02 | 0.02 |
| Viscosity Index | | | 112 | 112 | 114 | 111 |
| Evaluation Results | NOx-ISOT 240 hr 100° C. Kinematic Viscosity Ratio (viscosity increase suppressing effect) | | 1.4 | 1.8 | 1.4 | 1.4 |
| | NOx-ISOT Lifetime (unit: hour) (base number retention) | | 95 | 91 | 93 | 97 |
| | Hot Tube Test 300° C. Merit Score (high-temperature detergency) | | 2.5 | 4.0 | 6.5 | 2.5 |

TABLE 2

| | | | Example 9 | Example 10 | Example 11 | Example 12 | Example 13 |
|---|---|---|---|---|---|---|---|
| Base Oil (A) | Mineral Base Oil A-1 | mass % | 47.14 | 47.14 | 47.14 | 47.14 | 47.14 |
| | Mineral Base Oil A-2 | mass % | 38.21 | 38.15 | 37.61 | 37.61 | 37.61 |
| Ash-free Additive (B) | Sulfur-based Antioxidant (B1):thiocarbamate compound B1-1 | mass % | 0.40 | — | 0.40 | 0.40 | 0.40 |
| | Sulfur-based Antioxidant (B1):sulfur-containing triazine compound B1-2 | mass % | — | 0.56 | — | — | — |
| | Hindered Amine Compound B2-1 (number of piperidine-derived skeletons: 2) | mass % | 0.10 | — | 0.50 | 0.50 | 0.50 |
| | Hindered Amine Compound B2-2 (number of piperidine-derived skeleton: 1) | mass % | — | — | — | — | — |
| Boronated Imide-type Dispersant (C) | | mass % | 6.00 | 6.00 | 6.00 | 6.00 | 6.00 |
| Non-boronated Imide-type Dispersant (D) | | mass % | 6.30 | 6.30 | 6.30 | 6.30 | 6.30 |
| Metal-based Detergent (E) | Calcium-based Detergent E1-1: Ca sulfonate | mass % | — | — | — | — | — |
| | Calcium-based Detergent E1-2: Ca phenate | mass % | — | — | 0.08 | — | — |
| | Calcium-based Detergent E1-3: Ca salicylate | mass % | — | — | — | 0.08 | — |
| | Magnesium-based Detergent E2: Mg sulfonate | mass % | — | — | | - | 0.08 |
| Zinc Dithiophosphate (F) | Zinc Dithiophosphate F-1: Sec ZnDTP | mass % | — | — | 0.12 | 0.12 | 0.12 |
| | Zinc Dithiophosphate F-2: Aryl ZnDTP | mass % | — | — | — | — | — |
| Other Additive for lubricating oil | | mass % | 1.85 | 1.85 | 1.85 | 1.85 | 1.85 |
| Total | | mass % | 100.00 | 100.00 | 100.00 | 100.00 | 100.00 |
| Content of boron atom derived from boronated imide-type dispersant (C) | | ppm by mass | 860 | 860 | 850 | 860 | 850 |
| Content of phosphorus atom derived from zinc dithiophosphate (F) | | ppm by mass | 10> | 10> | 90 | 100 | 90 |
| Content of calcium atom derived from metal-based detergent (E) | | ppm by mass | 2> | 2> | 80 | 100 | 2> |
| Content of magnesium atom derived from metal-based detergent (E) | | ppm by mass | 2> | 2> | 2> | 2> | 80 |
| Sulfated Ash Content | | mass % | 0.02 | 0.02 | 0.11 | 0.10 | 0.10 |
| Viscosity Index | | | 111 | 111 | 111 | 111 | 111 |
| Evaluation Results | NOx-ISOT 240 hr 100° C. Kinematic Viscosity Ratio (viscosity increase suppressing effect) | | 1.4 | 1.6 | 1.5 | 2.0 | 1.8 |
| | NOx-ISOT Lifetime (unit: hour) (base number retention) | | 78 | 102 | 148 | 132 | 144 |
| | Hot Tube Test 300° C. Merit Score (high-temperature detergency) | | 2.0 | 3.5 | 3.0 | 3.5 | 3.5 |

| | | | Comparative Example 1 | Comparative Example 2 | Comparative Example 3 |
|---|---|---|---|---|---|
| Base Oil (A) | Mineral Base Oil A-1 | mass % | 47.14 | 47.14 | 47.14 |
| | Mineral Base Oil A-2 | mass % | 38.71 | 43.61 | 37.71 |
| Ash-free Additive (B) | Sulfur-based Antioxidant (B1):thiocarbamate compound B1-1 | mass % | — | 0.40 | — |
| | Sulfur-based Antioxidant (B1):sulfur-containing triazine compound B1-2 | mass % | — | — | — |
| | Hindered Amine Compound B2-1 (number of piperidine-derived skeletons: 2) | mass % | — | — | 1.00 |
| | Hindered Amine Compound B2-2 (number of piperidine-derived skeleton: 1) | mass % | — | — | — |
| Boronated Imide-type Dispersant (C) | | mass % | 6.00 | 0.70 | 6.00 |
| Non-boronated Imide-type Dispersant (D) | | mass % | 6.30 | 6.30 | 6.30 |
| Metal-based Detergent (E) | Calcium-based Detergent E1-1: Ca sulfonate | mass % | — | — | — |
| | Calcium-based Detergent E1-2: Ca phenate | mass % | — | — | — |
| | Calcium-based Detergent E1-3: Ca salicylate | mass % | — | — | — |
| | Magnesium-based Detergent E2: Mg sulfonate | mass % | — | — | — |

TABLE 2-continued

| | | | | | |
|---|---|---|---|---|---|
| Zinc Dithiophosphate (F) | Zinc Dithiophosphate F-1: Sec ZnDTP | mass % | — | — | — |
| | Zinc Dithiophosphate F-2: Aryl ZnDTP | mass % | — | — | — |
| Other Additive for lubricating oil | | mass % | 1.85 | 1.85 | 1.85 |
| Total | | mass % | 100.00 | 100.00 | 100.00 |
| Content of boron atom derived from boronated imide-type dispersant (C) | | ppm by mass | 859 | 100 | 860 |
| Content of phosphorus atom derived from zinc dithiophosphate (F) | | ppm by mass | 10> | 10> | 10> |
| Content of calcium atom derived from metal-based detergent (E) | | ppm by mass | 2> | 2> | 2> |
| Content of magnesium atom derived from metal-based detergent (E) | | ppm by mass | 2> | 2> | 2> |
| Sulfated Ash Content | | mass % | 0.02 | 0.02 | 0.02 |
| Viscosity Index | | | 112 | 111 | 112 |
| Evaluation Results | NOx-ISOT 240 hr 100° C. Kinematic Viscosity Ratio (viscosity increase suppressing effect) | | 1.3 | 1.4 | gelled |
| | NOx-ISOT Lifetime (unit: hour) (base number retention) | | 45 | 25 | 102 |
| | Hot Tube Test 300° C. Merit Score (high-temperature detergency) | | 5.5 | 0.0 | 3.5 |

The results in Table 1 and Table 2 reveal the following.

The lubricating oil compositions of Examples 1 to 13 had a low 100° C. kinematic viscosity ratio in the NOx-ISOT test and had a long lifetime in the NOx-ISOT test, and the hot tube test results thereof were good. Consequently, it is known that the lubricating oil compositions can suppress viscosity increase and are excellent in base number retention and high-temperature detergency.

As opposed to these, it is known that the lubricating oil composition of Comparative Example 1 not containing the ash-free additive (B) has a short lifetime in the NOx-ISOT test and is poor in base number retention.

Also it is known that the lubricating oil composition of Comparative Example 2 in which the content of the boron atom derived from the boronated imide-type dispersant (C) is less than 200 ppm by mass has a short lifetime in the NOx-ISOT test, and the hot tube test result thereof was a poor, and the composition is poor in base number retention and high-temperature detergency.

Further, it is known that the lubricating oil composition of Comparative Example 3 containing the hindered amine compound (B2) in an amount of 1.0% by mass as the ash-free additive (B) gelled in the process of the NOx-ISOT test.

The invention claimed is:

1. A lubricating oil composition, comprising:

a base oil (A);

at least one ash-free additive (B) selected from the group consisting of an ash-free sulfur-based antioxidant (B1) and a hindered amine compound (B2), wherein the ash-free sulfur-based antioxidant (B1) is at least one selected from the group consisting of a thiocarbamate compound, a sulfur-containing triazine compound and sulfurized oils and fats, and the hindered amine compound (B2) has one or two piperidine-derived skeletons;

a boronated imide-type dispersant (C), wherein a sulfated ash content is 0.2% by mass or less; and a non-boronated imide-type dispersant (D), wherein the content of the ash-free additive (B) is 1.2% by mass or less based on the total amount of the lubricating oil composition, provided that in the case where the ash-free additive (B) contains the hindered amine compound (B2), the content of the hindered amine compound (B2) is less than 1.0% by mass based on the total amount of the lubricating oil composition, and the content of the boron atom derived from the boronated imide-type dispersant (C) is 200 ppm by mass or more based on the total amount of the lubricating oil composition.

2. The lubricating oil composition according to claim 1, wherein the sulfated ash content is 0.01% by mass or more and 0.2% by mass or less.

3. The lubricating oil composition according to claim 1, wherein:

the content of the boron atom derived from the boronated imide-type dispersant (C) relative to the total content of the nitrogen atom derived from the boronated imide-type dispersant (C) and the nitrogen atom derived from the non-boronated imide-type dispersant (D) is 0.10 to 1.0 as a ratio by mass.

4. The lubricating oil composition according to claim 1, further comprising at least one metal-based detergent (E) selected from the group consisting of a calcium-based detergent (E1) and a magnesium-based detergent (E2), wherein:

the content of the metal atom derived from the metal-based detergent (E) is 50 to 200 ppm by mass based on the total amount of the lubricating oil composition.

5. The lubricating oil composition according to claim 1, further comprising a zinc dithiophosphate (F), wherein:

the content of the phosphorus atom derived from the zinc dithiophosphate (F) is 50 to 300 ppm by mass based on the total amount of the lubricating oil composition.

6. A method of lubrication, the method comprising:

applying the lubricating oil composition according to claim 1 to a gas engine equipped in a gas cogeneration system or equipped in a gas heat pump.

7. The lubricating oil composition according to claim 1, wherein the thiocarbamate compound is represented by at least one formula selected from the group consisting of (b1-1a) and (b1-1b), (b1-1a)

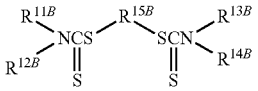

-continued (b1-1b)

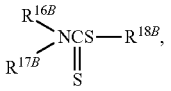

where $R^{11B}$, $R^{12B}$, $R^{13B}$ and $R^{14B}$ each represent an alkyl group having 1 to 30 carbon atoms, or a phenyl group, $R^{11B}$, $R^{12B}$, $R^{13B}$ and $R^{14B}$ may be the same or different, $R^{15B}$ represents an alkylene group having 1 to 10 carbon atoms, $R^{16B}$ and $R^{17B}$ each represent an alkyl group having 1 to 30 carbon atoms, or a phenyl group, $R^{16B}$ and $R^{17B}$ may be the same or different, and $R^{18B}$ represents a hydrogen atom or an alkylene group having 1 to 10 carbon atoms.

8. The lubricating oil composition according to claim 7, wherein the polysulfide compound includes at least one dihydrocarbyl polysulfide compound represented by a formula (b1-3), $$R^{21}—S_x—R^{22} \quad \text{(b1-3)},$$

where $R^{21}$ and $R^{22}$ each independently represent a hydrocarbon group selected from an alkyl group, linear or branched, having 3 to 20 carbon atoms, an aryl group having 6 to 20 carbon atoms, an alkylaryl group having 7 to 20 carbon atoms, an arylalkyl group having 7 to 20 carbon atoms, and an alkenyl group, linear or branched, having 3 to 20 carbon atoms, $R^{21}$ and $R^{22}$ may be the same or different, and x represents an integer of 2 to 10.

* * * * *